US005173676A

United States Patent [19]

Mullins et al.

[11] Patent Number: 5,173,676

[45] Date of Patent: Dec. 22, 1992

[54] ELECTRIC SWITCHES

[75] Inventors: Malcolm H. Mullins, Willingham; Frank Latham, Redbourn, both of England

[73] Assignee: M.K. Electric Limited, London, England

[21] Appl. No.: 650,800

[22] Filed: Feb. 6, 1991

[30] Foreign Application Priority Data

Feb. 7, 1990 [GB] United Kingdom ..... 9002678

[51] Int. Cl.[5] ..... H01H 9/00

[52] U.S. Cl. ..... 335/172; 335/21; 335/176

[58] Field of Search ..... 335/6, 21-24, 335/167-176, 16, 147

[56] References Cited

U.S. PATENT DOCUMENTS 2,360,682 10/1944 Hutt .
3,943,316 3/1976 Oster .
3,943,472 3/1976 Oster et al. .
3,944,953 3/1976 Oster .
3,946,346 3/1976 Oster et al. .
3,956,723 5/1976 Dickens et al. .
4,070,641 1/1978 Khalid .
4,178,618 12/1979 Khalid .
4,346,356 8/1982 Fujiwara et al. ..... 335/6

FOREIGN PATENT DOCUMENTS 602777 4/1974 Australia .
299291 1/1989 European Pat. Off. .
1943426 4/1970 Fed. Rep. of Germany .
2158745 10/1972 Fed. Rep. of Germany .
2519092 10/1975 Fed. Rep. of Germany .
1227285 8/1969 United Kingdom .
1387990 3/1975 United Kingdom .

*Primary Examiner*—Lincoln Donovan
*Attorney, Agent, or Firm*—Amster, Rothstein & Ebenstein

[57] ABSTRACT

An electric switch in which a manually-operable dolly is angularly displaceable about a first axis through a top dead center (TDC) position between the extreme positions towards which it is urged by spring means after passing the TDC position to produce a toggle or snap-action effect, the dolly in one extreme position causing or allowing a movable contact to engage another contact and in the other extreme position causing or allowing the movable contact to disengage the other contact. A tail member is mounted for angular displacement about said first axis and the movable contact is carried on an arm mounted on the tail member intermediate its length for pivotal movement about a second axis parallel to the first axis. The arm is engaged by the tail member on the side remote from the movable contact to prevent the arm pivoting about said second axis, and the spring means is operable between the dolly and the arm angularly to displace the tail member about the first axis and by its engagement with the arm displace the arm about the first axis to bring the movable contact into or out of engagement with the other contact.

12 Claims, 6 Drawing Sheets

OFF
ON
1
2
2a
2b
3
4
4a
4b
5
6
6a
7
8
8a
9
10
11
12
13
13a
13b
14
15
15a
16
17
18
19
19a
20
21
22
24
27
28
29
30
31
32
34
35
36
37
40
41
F
G
X
Y

ON
OFF
1
2
2a
3
4
X
7
8a
9
12
13
14
15
15a
18
19
21
22
23
24
26
27
29
33
36
37
41
6
G
F
Y

ELECTRIC SWITCHES

This invention relates to electric switches and is concerned with electric switches of the kind (hereinafter referred to as being of the "kind specified") in which a manually operable member is angularly displaceable about a first axis through a top dead centre (TDC) position between two extreme positions towards which it is urged by biasing means after passing the TDC position to produce a toggle or snap-action effect, the member in one extreme position causing or allowing a movable contact to engage another contact and in the other extreme position causing or allowing the movable contact to disengage the other contact. The manually-operable member may be the switch-operating member or may be operable by the switch operating mechanism directly or by way of a further linkage or mechanism.

The present invention broadly stated provides a switch of the kind specified in which a tail member is mounted for angular displacement about said first axis, the movable contact is carried on an arm mounted on the tail member intermediate its length for pivotal movement about a second axis parallel to the first axis, the arm is engaged by the tail member on the side remote from the movable contact to prevent the arm pivotting about said second axis, and the biasing means is operable between the manually-operable member and the arm angularly to displace the tail member about the first axis and by its engagement with the arm displace the arm about the first axis to bring the movable contact into or out of engagement with the other contact. When the arm and tail member are disengaged on the side remote from the movable contact, biassing means causes the arm to pivot about the second axis to bring or maintain the movable contact out of engagement with the other contact.

This arrangement, with what is to some extent a floating tail member, enables any tendency of the contacts to bounce when brought into engagement to be largely absorbed by the tail member with a consequent reduction in any tendency for pitting or arcing to occur. Also, as the position of the movable contact is normally controlled by engagement of the arm with the tail member, it becomes possible by releasing this engagement to actuate the switch to disengage the contacts without manually operating the member. Thus trip means may be provided which is operable to release the arm from engagement with the tail member and to displace the arm about the second axis to disengage the contacts without displacing the dolly. An electromagnetically operable device may be provided which is operable to trip the switch when a predetermined electrical condition is attained in an external circuit. The switch can therefore be used as a circuit breaker.

Such an electromagnetically operable device can, with advantage, be a solenoid having an armature operable to bear directly or indirectly on the arm and, when the predetermined electrical condition is attained, to pivot the arm about the second axis and displace the movable contact to trip the switch.

With advantage, the other contact is carried on a further arm mounted for angular displacement about a third axis and connected to the arm carrying the movable contact so as to move the said other contact in a direction opposite to the movable contact to move both contacts towards or away from each other and increasing the speed of engagement or separation.

It is preferred to locate the second axis with respect to the movable contact and the first axis such that the movable contact, when displaced, moves along the arc of a first circle centred on the first axis. The other contact, when displaced, moves along the arc of a second circle centred on the third axis and the movable contact and the other contact are arranged to close or engage on the arc of a third circle which intersects the first and third axes at points at the extreme ends of a diameter of that third circle. This means that, at this point of closure, the contacts approach each other substantially at right angles thereby achieving high speed and also reducing bounce and arcing.

Also, when the dolly is manually operated to open the switch, the contacts part from each other substantially at right angles. However, where trip means is provided, operation of the trip means releases the arm from engagement with the tail member and frees the movable contact to pivot about the second axis to move the movable contact away from the other contact at substantially 180°.

One embodiment of the invention will now be described by way of example, reference being made to the accompanying drawings, in which.

Figure 1:
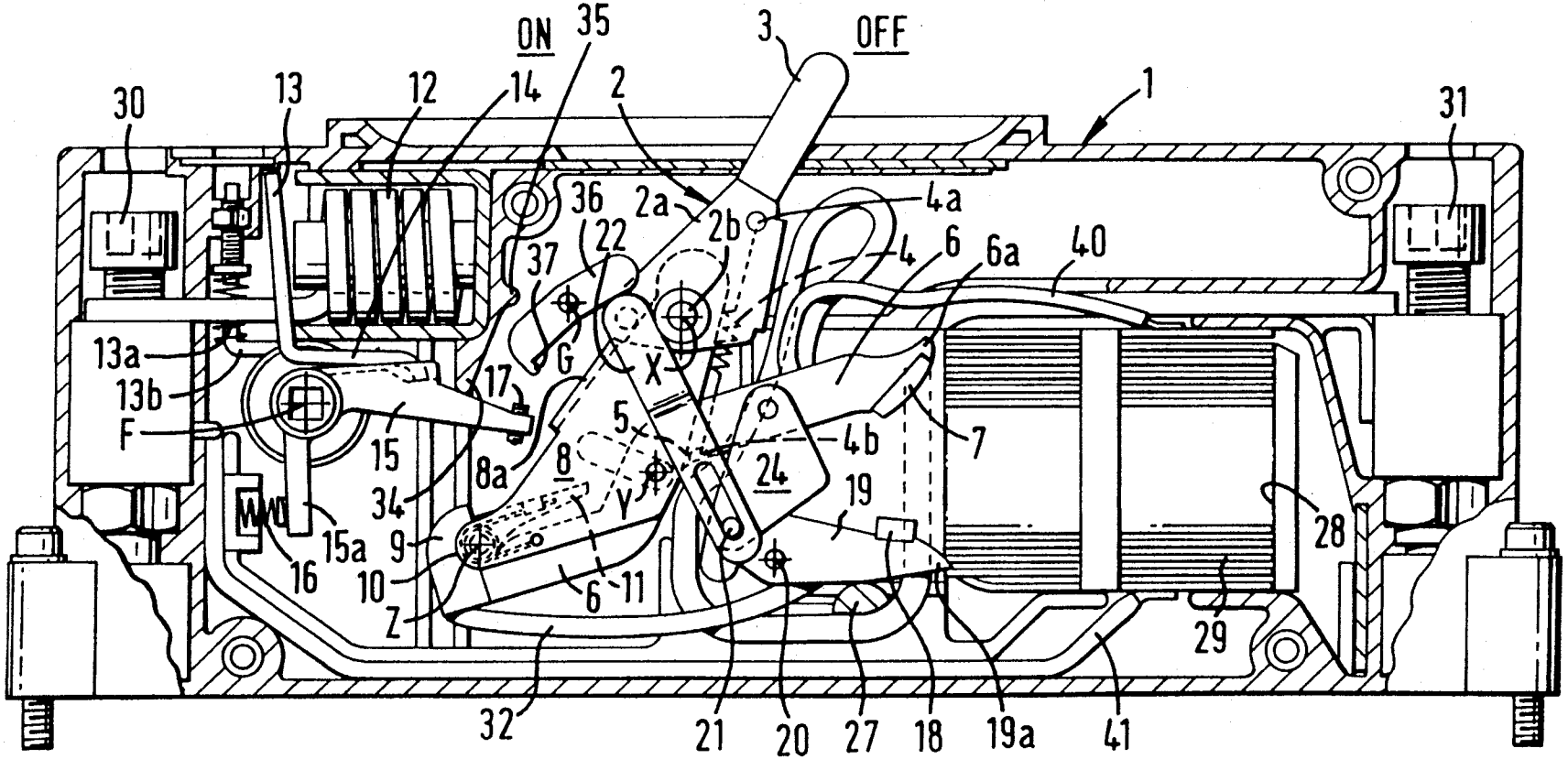
FIG. 1 is a side elevation of a switch or circuit breaker according to the invention shown in the "OFF" position with the contacts open.

The switch comprises a housing indicated generally at 1 in which is pivotally mounted a dolly indicated at 2 having an extension 3 extending outside the casing 1 for manual operation. The dolly 2 comprises a substantially U-shaped member with two spaced parallel walls **2*a* by which it is mounted in the housing by trunnions 2*b* for angular displacement about a first axis X to leave the space between the plates free for displacement of a spring 4 or other resilient or elastic means from one side to the other of the axis X to produce a snap or toggle action. As viewed in FIG. 1, the spring 4 is attached at one end 4*a* to a part of the dolly 2 above the axis X and in proximity to the extension 3 and at the other or lower end 4*b* it is engaged in a slot 5 in a cranked arm 6 carrying at one end a movable contact 7. In the OFF or open position of the switch shown in FIG. 1, the line of action of the spring 4 is to the right of the axis X and also to the right of a fulcrum or second axis Y about which the cranked arm 6 can pivot. As can be seen in FIG. 1, the first and second axes X and Y are parallel to each other. Also mounted for pivotal movement about the axis X is a substantially triangular shaped tail member 8 composed of a pair of spaced parallel plates extending away from a base or bridge 8*a* and between which the spring 4 can move. The cranked arm 6 passes between these plates 8 and is carried thereby for pivotal movement about the second axis Y. The end of the cranked arm 6 remote from the movable contact 7 carries an upstanding rib 9 having a partial circular groove 10 which rotatably receives the partial circular part 11*a* by which a trip lever 11 is mounted on the end of the tail 8** for rotation about a further axis Z. The trip lever 11 has an arm 11*b* extending away from the axis Z and a shoulder or rib 11*c* which engages an overhang 9*a* of the rib 9 during normal operation of the switch so that anti-clockwise movement of the lever 11 about the further axis Z is normally limited by such engagement. A hair spring 11*d* has one arm 11*e* engaged with the tail 8 and the other arm 11*f* engaged with the arm 11*b* normally to urge the rib 11*c* and the overhang 9*a* into engagement.

The engagement of the rib 9 and lever 11 ensures that during normal operation of the dolly 2 between the two extreme "ON" and "OFF" positions, the arm 6 is restrained against movement about the axis Y and moves with tail member 8 about the axis X. Under these conditions, the movable contact 7 similarly moves about the axis X.

Figure 4:
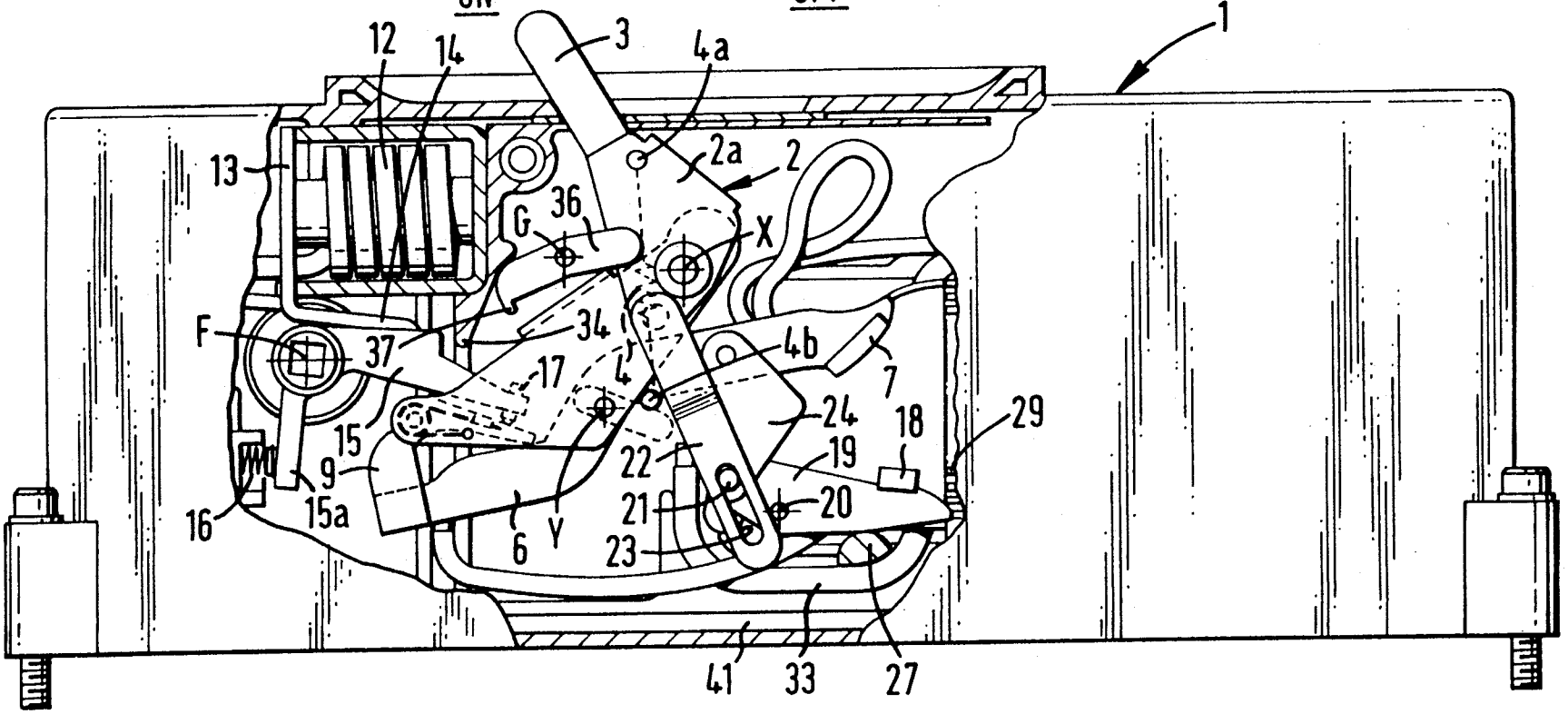
FIG. 4 is a view similar to FIG. 1 showing the switch in an intermediate tripped position.
Figure 5:
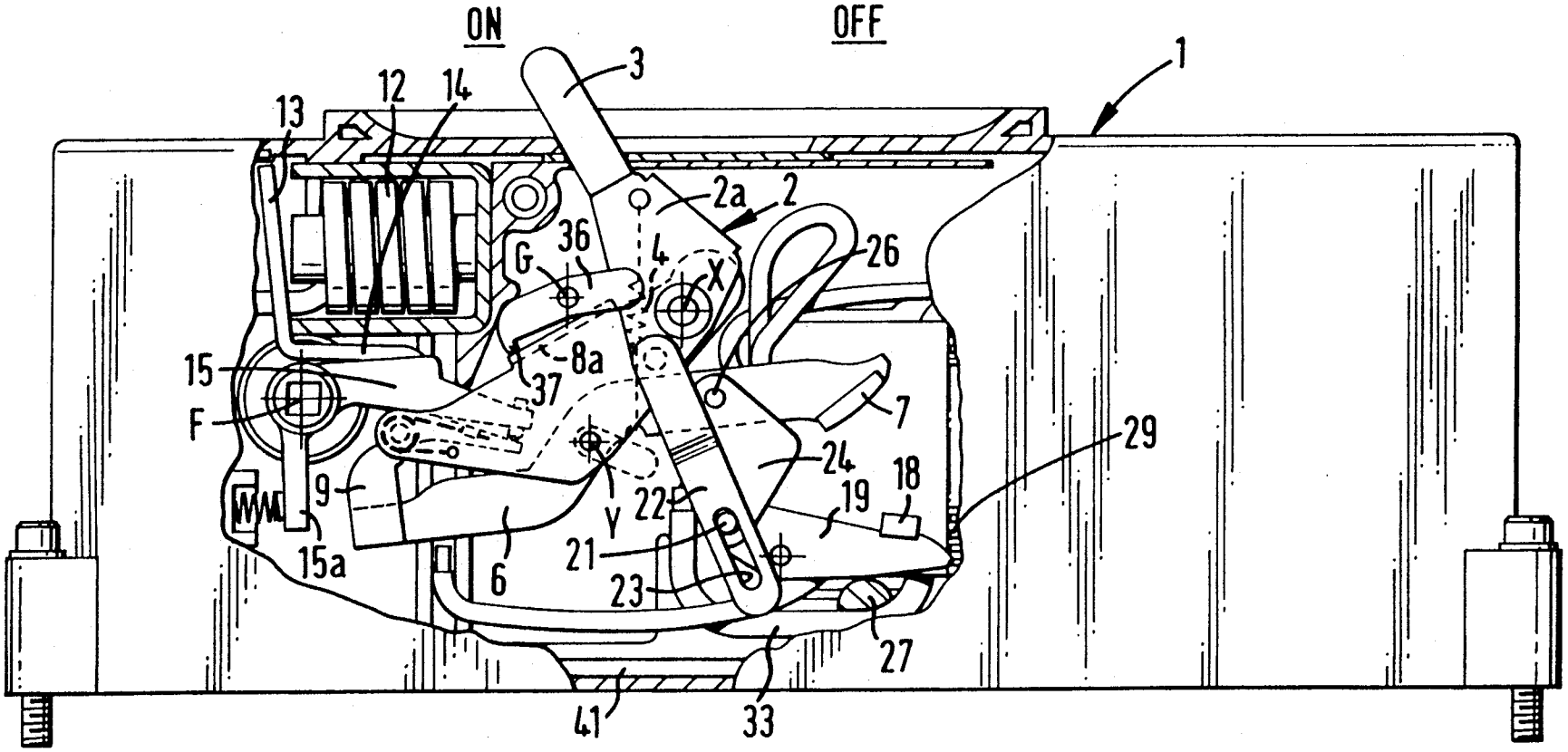
FIG. 5 is a view similar to FIG. 4 showing the switch in the final tripped position.
Figure 6:
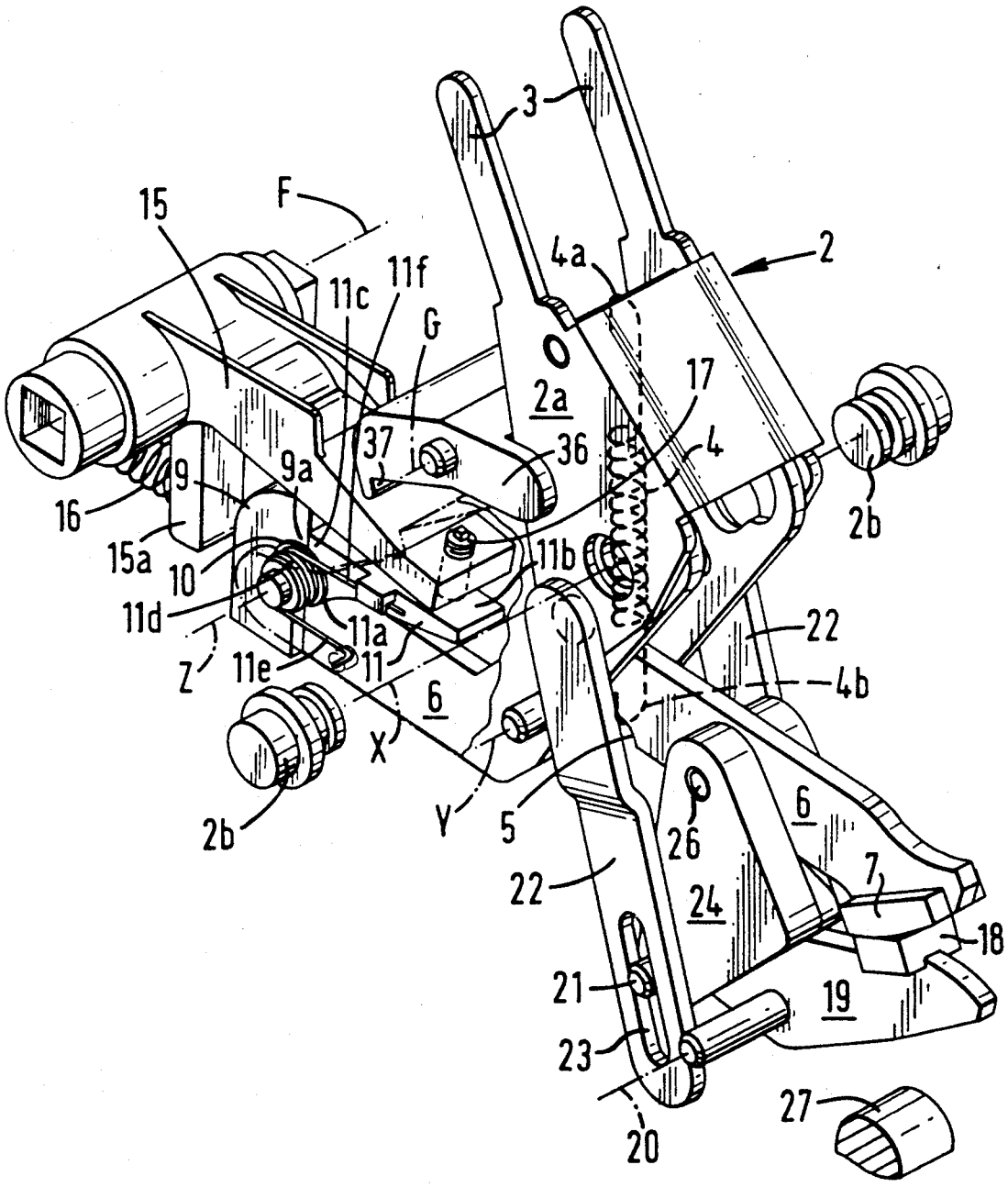
FIG. 6 is a fragmentary perspective view of a part of the switch mechanism.

A solenoid 12 is provided in the housing and is operable to trip the switch by actuation of a pivotally mounted armature 13 having a finger 14 which bears against a pivotally mounted insulated lever 15 which is biased by a resilient means 16 against the finger 14 and carries an adjustable nib 17 intended to bear against the arm 11*b*. In this example, the resilient means 16 is a coil spring in a cup which bears against a tail 15*a* formed integrally with the lever 15. The armature 13 is provided with a pressed out integral lug 13*b* which bears against adjustable resilient means 13*a* which determines the magnitude of the current required through the solenoid 12 to actuate the armature. When the solenoid 12 is energised by a sufficiently large current, the armature 13 pivots clockwise (as shown in FIG. 1) and the finger 14, through the nib 17, pivots the arm 11*b* in the clockwise direction to disengage the rib 11*c* and overhang 9*a* and also to cause the arm 11*b* to bear against the cranked arm 6 and turn it in the anti-clockwise direction about the axis Y to trip the switch to the position shown in FIG. 4.

In the preferred embodiment of the invention illustrated, the second contact is also movable with the advantage that the make or break action resulting from the two contacts engaging or disengaging is much quicker than when only one contact is moved with the result that the degree of current limiting introduced into the circuit breaker is increased. The second movable contact is identified by the reference 18 and is carried towards the end of an arm 19 pivotally mounted intermediate its length for rotation about a third axis 20 and is connected at its other end by a rod 21 to a pair of insulated links 22 the other ends of which links 22 are pivotally connected to the spaced plates 2*a* of the dolly 2. The rod 21 extends through slots 23 in the links 22 to provide a limited lost motion connection. The rod 21 is also connected by a substantially triangular plate 24 of insulating material to the cranked arm 6 at a location 26 between the slot 5 and the contact 7 so that the spacing between the rod 21 and the location 26 remains constant. The clockwise displacement of the arm 19 and the contact 18 (as seen in FIG. 1) is limited by a stop 27. The fixed link provided by the plate 24 ensures that as the arm 6 is moved away from the arm 19, the rod 21 moves in the same direction to pivot the arm 19 about the axis 20 to move the contact 18 away from the contact 7 thereby increasing the speed of separation.

Also, the apex of the triangular plate 24 faces the contacts 7 and 18 so that the arc is prevented from travelling inwards between the arms 6 and 19 on separation, it has to follow a path of increasing length and is rapidly extinguished.

The second axis Y is located with respect to the movable contact 7 and the first axis X such that the movable contact 7, when displaced, moves along the arc of a circle centred on the first axis X. The third axis 20 is parallel to the axes X and Y and the contact 18, when displaced, moves along the arc of a circle centred on the axis 20. The contacts 7 and 18 are arranged to close or engage on the arc of a circle of which the distance between the first axis X and the third axis 20 forms a diameter so that at this point, the contacts approach each other substantially at right angles, thereby achieving high speed and also reducing arcing and bounce. When the switch is manually operated by the dolly 2 to move the contacts 7 and 18 apart, they part substantially at right angles. However, when the trip lever 11 is operated, the arm 6 is freed from the tail member 8 and is displaced by the spring 4 to pivot about the axis Y and moves the contacts 7 and 18 apart initially along a substantially rectilinear line thus increasing the speed of parting.

The contacts 7 and 18 are disposed in proximity to an arc extinction chamber 28 which is a simple chamber with spaced parallel plates 29 to break up any arc which might be generated between the contacts 7 and 18. It will be noticed that in the OFF position shown in FIG. 1 the noses 6*a* and 19*a* at the contact ends of the arms 6 and 19 are designed to be effectively continuations of the outermost plates 29 in the chamber 28.

Normal operation of the switch by actuation of the extension 3 between the extreme "ON" and "OFF" positions produces an angular displacement of the dolly 2 about the axis X and a snap action due to the spring 4 which pivots the tail member 8 about the axis X and, with it, the arm 6 to bring the contacts 7 and 18 into engagement or to move them apart to disengage them, whatever the case may be.

When the switch is intended to act as a circuit breaker it will be intended to respond to an external condition to break the circuit by disengaging the contacts 7 and 18.

The switch has two terminals 30 and 31, terminal 30 being connected through solenoid 12 and conductor 32 to contact 18 and terminal 31 being connected through conductor 33 to contact 7.

In the event of a moderate overload in the circuit, the armature 13 will be attracted to the solenoid 12 and tend angularly to displace the insulated lever 15 clockwise against resistance by the resilient means 16. By adjusting resilient means 16, the magnitude of the overload required to displace the lever 15 can be controlled. Displacement of the lever 15 causes the nib 17 to bear against the trip lever 11 and disengage the arm 6 from the tail member 8 to allow the contacts 7 and 18 to separate under the influence of the pull-off spring 4.

For high short-circuit fault conditions, the resistance of the resilient means 16 is minimal and the contacts 7 and 18 part at high speed.

It will also be appreciated that the switch can be made to assume an open circuit condition when the sensed value of an external parameter is not at a predetermined value or within a predetermined range of values. This difference could be used in known manner to generate an error signal operable to open-circuit the switch.

For example, such an error signal could release stored energy from an energy storage device which could be electrical or mechanical. Electrical energy could actuate the switch through a solenoid coil as described and mechanical energy could be used to rotate a pivot F of the lever 15 which pivot could (in this case) be square or otherwise keyed to the lever 15.

Figure 2:
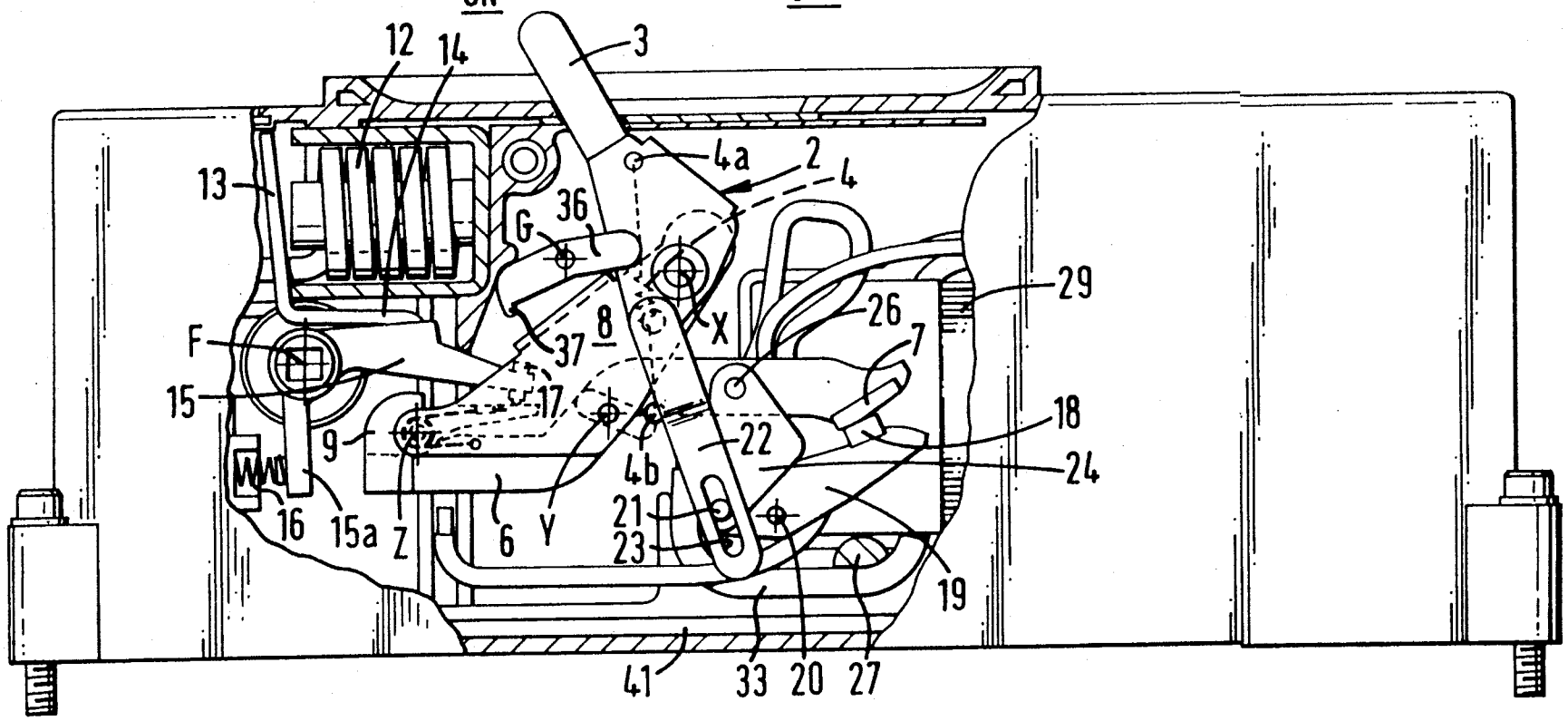
FIG. 2 is a view similar to FIG. 1 showing the switch in the "ON" position with the contacts closed.

It should be noted that the housing 1 is formed with a limit stop 34 which limits the anti-clockwise displacement of the lever 15 and a further stop 35 which limits the clockwise displacement of a member 36 which pivots freely in the housing about an axis G and which has a nose 37 which is engageable with the dolly 8. The links 22 are lazy links due to the lost motion resulting from the slot 23 and have little part to play in the normal operation of the switch. However, when the switch is being manually operated from the closed position shown in FIG. 2 to the open position shown in FIG. 1, the upper ends of the links rise and strike the tail of the member 36 to pivot it about the axis G and cause the nose to strike the base 8*a* of the tail member 8 and encourage it to snap over to the open position. This prevents the switch achieving the rather delicate balance which can sometimes be achieved at top dead centre.

In the event that the contacts 7 and 18 should become welded together with the switch in the ON position, an attempt to operate the switch by displacing the manual extension 3 to the OFF position will cause the dolly 2 to pivot about the axis X to raise the links 22. Once the lost motion due to the slot 23 has been lost, the raising of the links 22 will tend to cause the arm 19 of the contact 18 to pivot in the clockwise direction (as seen in FIG. 1) about the axis 20. tending to move the contact 18 away from the contact 7. If the weld can be broken, any such movement is transmitted through the link 24 to move the contact 7 away from the contact 18 to reinforce the effect. Additionally, the top of the links 22 will engage the tail of the member 36 urging the nose 37 to strike the base 8*a* of the tail member 8 and reinforce the tendency to break such a weld. If the weld is broken, the dolly 2 moves to the OFF position and no further action need be taken. However, if the weld does not break, then the links 22 prevent the dolly 2 passing over the top dead centre position and snapping over to the OFF position. The operator trying to achieve such an operation is immediately made aware of the fault and the need for a replacement switch.

Figure 3:
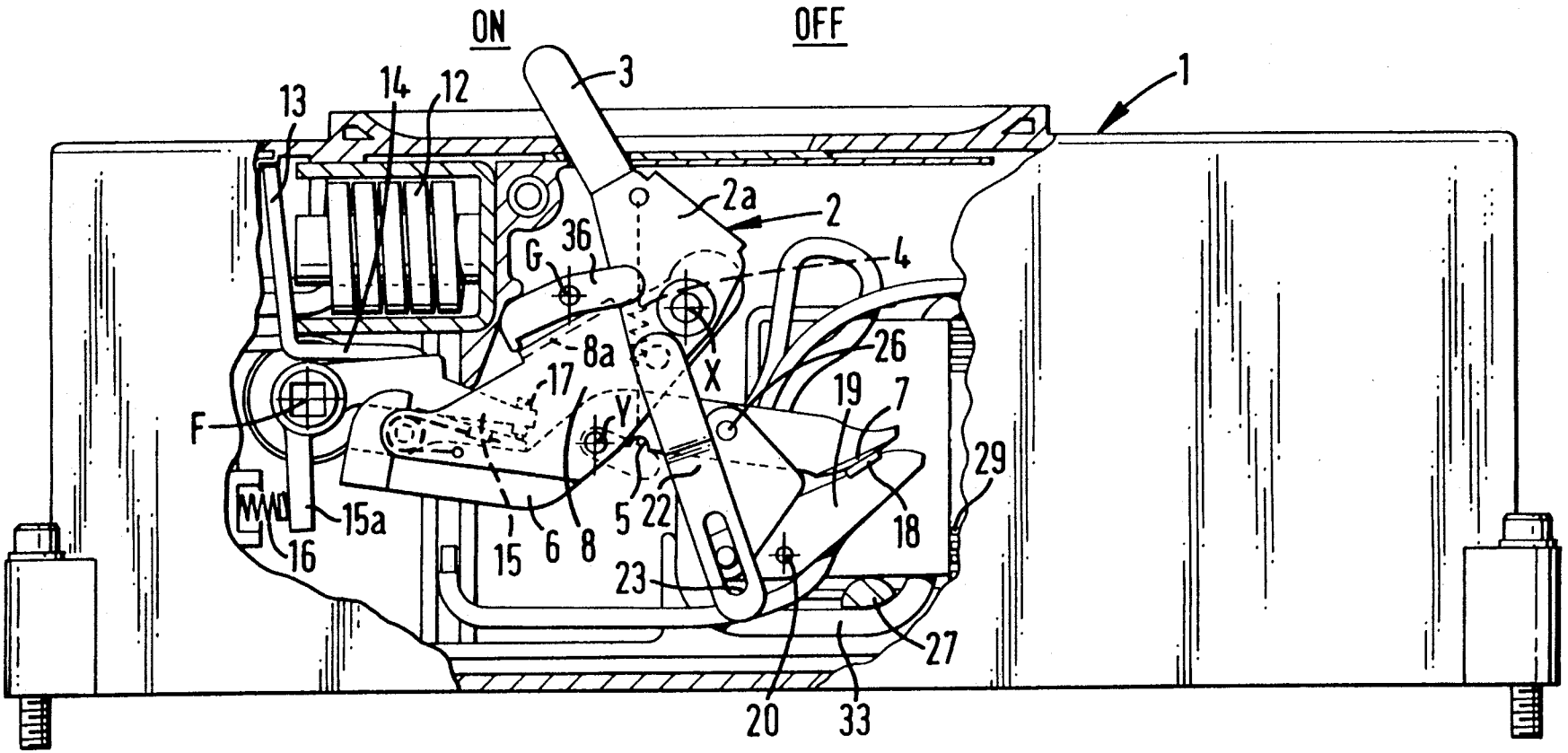
FIG. 3 is a view similar to FIG. 1 illustrating extremely worn contacts in the closed position.

It can be seen from FIG. 3 that when the contacts 7 and 18 are worn to a significant extent, the angular displacement of the cranked arm 6 about the pivot axis X increases to the extent that the trip lever 11 is carried against the nib 17 and the switch is tripped by the spring 4 displacing the arm 6 anti-clockwise. The effect is that as the dolly 2 is manually displaced from the OFF or open position of the switch to the ON or closed position, the switch is tripped to open the circuit, although the manual extension 3 remains in the ON position providing evidence to an operator that the switch needs repair.

On the other hand, if for any reason the contacts 7 and 18 should become welded together in the ON position of the manual extension 3, the switch will remain showing itself to be in the ON condition.

Another feature of note is the electrical connection to the arc extinction chamber 28. The spaced parallel plates are intended to break up any arc which might move from the contacts 7 and 18 into the chamber. There is, however, an electrical connection to one side of the chamber by conductor 40 from the arm 6 and to the other side of the chamber by conductor 41 from terminal 30. If an arc should enter the chamber 28, the air will be ionised and the current will be reduced due to the increase in arc voltage and the arc will be prevented from returning to the contacts 7 and 18.

We claim:

1. A switch comprising a manually operable member which is angularly displaceable about a first axis through a top dead centre position between two extreme positions towards which it is urged by biassing means after passing the top dead centre position to produce a toggle or snap-action effect, a movable contact and another contact, a tail member mounted for angular displacement about said first axis, an arm mounted at a point intermediate its length on the tail member for pivotal movement about a second axis parallel to the first axis, the arm carrying the movable contact and being releasably engaged by the tail member on the side remote from the movable contact to prevent the arm pivoting about the second axis during normal use, whereby in normal use the arm and tail member are engaged and move together about the first axis, the biassing means being operable between the manually operable member and the arm to angularly displace the arm and the tail member about the first axis so as to bring the movable contact into or out of engagement with the other contact according to the position of the manually operable member.

2. A switch according to claim 1 comprising trip means operable to release the arm from engagement with the tail member, the biassing means causing displacement of the arm about the second axis without displacing the tail member, so as to bring or maintain the movable contact out of engagement with the other contact.

3. A switch according to claim 2 in which the trip means is an electromagnetically operable device.

4. A switch according to claim 3 in which the electromagnetically operable device is a solenoid having an armature operable to bear directly or indirectly on the arm.

5. A switch according to claim 1 in which the other contact is carried on a further arm mounted for angular displacement about a third axis and connected to the arm carrying the movable contact so as to move the said other contact in a direction opposite to the movable contact to move both contacts towards or away from each other and increasing the speed of engagement or separation.

6. A switch according to claim 5 in which the second axis is located with respect to the movable contact and the first axis such that the movable contact, when displaced, moves along the arc of a first circle centred on the first axis, the other contact, when displaced, moves along the arc of a second circle centred on the third axis and the movable contact and the other contact are arranged to close or engage on the arc of a third circle intersecting the first and third axes at points at the extreme ends of a diameter of that third circle.

7. A switch according to claim 5 comprising arc extinguishing means for extinguishing an arc formed on separation of the contacts.

8. A switch according to claim 7, wherein said further arm is connected to the arm by way of a substantially triangular plate of insulating material whereby an apex of said plate faces said contacts.

9. A switch according to claim 7, wherein said contacts are arranged in proximity to an arc extinction chamber.

10. A switch according to claim 4, in which the other contact is carried on a further arm mounted for angular displacement about a third axis and connected to the arm carrying the movable contact so as to move the said other contact in a direction opposite to the movable contact to move both contacts towards or away from each other and increasing the speed of engagement or separation.

11. A switch according to claim 10, comprising an arc extinguishing means for extinguishing an arc formed on separation of the contacts.

12. A switch according to claim 1 in which the manually-operable member comprises a switch dolly.

* * * * *